US005314702A

United States Patent [19]

Lewandowski et al.

[11] Patent Number: 5,314,702

[45] Date of Patent: May 24, 1994

[54] VENTED DOUGH CAN

[75] Inventors: Daniel J. Lewandowski, Burnsville; David A. Kirk, Brooklyn Park, both of Minn.

[73] Assignee: The Pillsbury Company, Minneapolis, Minn.

[21] Appl. No.: 852,079

[22] Filed: Mar. 16, 1992

[51] Int. Cl.[5] ..... B65D 85/72

[52] U.S. Cl. ..... 426/128; 206/830; 426/395; 426/398; 426/496; 426/524; 426/551

[58] Field of Search ..... 426/128, 395, 398, 496, 426/524, 551; 206/830

[56] References Cited

U.S. PATENT DOCUMENTS

| | | | |
|---|---|---|---|
| 1,811,772 | 6/1931 | Willoughby . | |
| 1,861,124 | 5/1932 | Lorber . | |
| 1,887,162 | 11/1932 | Lorber . | |
| 1,988,091 | 1/1935 | Schumacher | 426/128 X |
| 2,855,884 | 10/1958 | Magill | 156/183 |
| 2,891,714 | 6/1959 | Vallas | 229/202 |
| 3,009,626 | 11/1961 | Johnson | 229/201 |
| 3,220,598 | 11/1965 | Fried et al. | 220/277 |
| 3,356,506 | 12/1967 | Matz | 426/331 |
| 3,397,064 | 8/1968 | Matz | 426/551 |
| 3,510,050 | 5/1970 | Culley et al. | 229/202 |
| 3,669,682 | 6/1972 | Lutz | 426/331 |
| 3,879,563 | 4/1975 | Tucker et al. | 426/128 |
| 3,972,468 | 8/1976 | Reid | 229/202 |
| 3,981,433 | 9/1976 | Thornhill et al. | 229/202 |
| 4,091,718 | 5/1978 | Thornhill | 493/67 |
| 4,235,341 | 11/1980 | Martin et al. | 229/202 |
| 4,241,834 | 12/1980 | Beauchamp | 229/202 |
| 4,381,315 | 4/1983 | Yong et al. | 426/94 |
| 4,426,401 | 1/1984 | Ottow et al. | 426/394 |
| 5,084,284 | 1/1992 | McDilda et al. | 426/128 |

FOREIGN PATENT DOCUMENTS

| | | |
|---|---|---|
| 2307723 | 4/1976 | France . |

*Primary Examiner*—Leo B. Tentoni
*Attorney, Agent, or Firm*—Kinney & Lange

[57] ABSTRACT

A dough can capable of venting internal gasses during proofing until the dough expands to fill the volume of the container is disclosed. The container of the present invention includes a cylindrical body, at least one end cap, a second end and means for allowing venting of internal gasses during proofing. A preferred means includes providing at least one notch in the wall of the container proximate the end cap. A method of proofing dough is also disclosed.

10 Claims, 3 Drawing Sheets

VENTED DOUGH CAN

BACKGROUND OF THE INVENTION

The present invention relates to containers for storing refrigerated dough. In particular, it relates to dough containers capable of venting internal gasses created by or displaced as a result of the proofing process.

During the manufacture of packaged refrigerated dough products, the dough product is often exposed to oxygen in the headspace within the container for an extended period of time after packaging. When this occurs, the quality of the product deteriorates leaving a product which is unacceptable to consumers. "Headspace" for purposes of this disclosure is the void volume within the container after inserting the product and closing the container.

Many of the quality problems result from the dough being exposed to oxygen or other headspace gasses for extended periods of time. When dough is exposed to oxygen, the dough can become discolored, the product can become deformed and liquids can accumulate in the container wetting the product. Additionally, loud noises can occur when the consumer opens the container. The noise is a result of the presence of compressed headspace gasses within the can.

One of the largest problems caused by refrigerated dough contacting oxygen for extended periods of time is discoloration of the dough. The dough turns a distinct grayish color. This greying is unacceptable to consumers and results in consumer complaints. Although grey dough is safe for consumption, consumers refuse to prepare discolored dough because they believe the dough is spoiled.

Wetness in the product is the result of the collection of liquid at the interface between the gas and the dough within the container. The dough becomes wetted with the collected liquid which may be either oily or milky in appearance. All of the above-identified quality problems are unacceptable to consumers.

Manufacturing dough for refrigerated storage is well known. Examples of refrigerated dough which are purchased and baked at home include dough for preparing bread-like products such as biscuits, loafs, breakfast rolls, pastries, pizza crust, and bread sticks. The dough for these products is prepared by the manufacturer and then packaged in containers suitable for processing, shipping, and storing.

Dough prepared for refrigerated storage are generally chemically leavened. Therefore, dough compositions commonly include a combination of a slow acting leavening acid and an alkaline substance capable of releasing carbon dioxide upon reaction with the leavening acid. The most common systems include either glucono delta lactone or sodium acid pyrophosphate as the acidulant with sodium bicarbonate. Examples of patents which disclose refrigerated dough compositions 25 are Yong et al. U.S. Pat. No. 4,381,315, Matz U.S. Pat. Nos. 3,356,506 and 3,397,064, and Lutz U.S. Pat. No. 3,669,682.

Dough compositions of the type discussed above can be either proofed before or after packaging. "Proofing" for purposes of this disclosure is defined as a step in which the dough increases in volume as a result of leavening. The leavening agents react and expand the dough by approximately to 30 volume percent. After proofing, the dough is further developed by storage in a sealed container at refrigeration temperatures until a point in which the internal pressure of the container has reached a selected equilibrium pressure (typically about 10 psi), and the dough temperature is the same as the temperature of the refrigerated storage area (typically about 45 degrees Fahrenheit).

Proofing of the dough is typically accomplished by first packaging the dough in a container which allows gas to escape until the dough expands to a volume sufficient to completely fill the container. U.S. Pat. No. 3,897,563 to Tucker et al. which is herein incorporated by reference describes a method of proofing and developing of refrigerated dough products. The dough is first packaged to fill between about 70 and about 99 percent of the volume of a spirally wound container. The container is then covered with a cap capable of venting gasses. The filled containers are stored for a period of about 1 to about 6 hours. During this time the leaveners react producing carbon dioxide which expands the dough. After the dough has filled the container, proofing is complete.

Next, the dough is developed. The containers are placed in refrigerated storage for a time sufficient for the internal pressure in the container to build and continue to rise until reaching a target equilibrium pressure of between about 8 and 28 psi. Pressure equilibrium is usually reached between about 8 and about 48 hours.

Containers suitable for packaging and storing refrigerated dough as described above must be able to vent gasses present in the headspace of the can before proofing and gasses produced by the dough during proofing. The container must also be able to withstand internal pressures of up to 40 psi.

One end cap construction known in the art which is capable of venting gasses is shown in cross-section in FIG. 1. Prior art composite container 10 has a single crimp end cap configuration. The container wall 11 is multilayered and is substantially cylindrical. Each end of the container wall has an inner sealing surface 14, an outer sealing surface 16 and an outer edge 17.

The end cap 12 has an inner lip 18 extending over the inner sealing surface 14 and an integrally formed outer lip 20. The outer lip 20 includes an infolded layer 22 which is folded inwardly, abutting the outer lip 20 and extending over the outer sealing surface 16. The outer lip 20 and inner lip 18 are then compressed, squeezing the cylindrical container wall and sealing the dough into the container.

This construction, known in the art as a single crimp end cap, typically allows some gasses to vent from within the container, and does not allow the dough composition to escape. When the dough within the container expands and comes into contact with the end cap 12, or when oil or water plugs the gas escape path, the can seals and pressure begins to build within the container.

Although in theory a single crimp end cap construction is desirable for proofing and developing dough at pressures close to one atmosphere, in practice, the gas escape paths prematurely seal and pressure begins to rise within the container during either proofing, developing, or both.

"Premature sealing" for the purposes of this disclosure includes any sealing of the escape path which occurs before the dough has fully expanded to fill the container and before the dough has been fully proofed. This premature sealing may be partial or total. Even a partial sealing of the gas escape path results in a significant reduction in vent rate and results in premature positive pressure build-up within the container. If the escape path seals before the dough has fully expanded, the gasses present in the headspace are not exhausted, and remain in contact with the dough for an extended period of time, causing quality problems to occur.

Although the inventors do not wish to be bound by any theory of why premature sealing occurs, we believe that there are several potential causes. Water or oil from inside the container may be forced into the venting path and may effectively seal the path, prohibiting gasses from escaping. The composite core layer of the container wall is often formed in part from paper material such as paperboard and may become saturated with either oil or water causing the paperboard to expand. Such an expansion might cause the composite portion of the can to press outwardly and upwardly against the cap and partially or totally seal off the escape path. Another potential cause of premature sealing may result from crimping the end cap too tightly onto the end of the container.

Numerous spirally wound composite can configurations are known for use with refrigerated dough. Typically, they are designed to withstand internal pressures generated by the dough. Several examples of a suitable container designs are described in Culley et al. U.S. Pat. No. 3,510,050, Reid U.S. Pat. No. 3,972,468, Beauchamp U.S. Pat. No. 4,241,834, and Thornhill U.S. Pat. No. 3,981,433. Such containers generally have bodies which include a multilayer spiral wound cylindrical structure having substantially flat, circular single crimp end covers. The container body has a core layer which is formed from a relatively stiff can-grade paperboard. The container body is formed by known spiral winding methods. Adhesively bonded to the inner surface of the core layer is a water and oil impermeable layer. Adhesively bonded to the exterior surfaces of the core layer is a label layer which also protects the core layer from damage due to exposure to high humidity environments, for example.

The cylindrical portion of a spirally wound composite can is continuous and has a smooth edge which contacts the cap. Likewise, the cap is comprised of a substantially flat metal piece which contacts the cylindrical portion of the container by means of a single crimp around the periphery of the cap.

SUMMARY OF THE INVENTION

A refrigerated container suitable for use with refrigerated dough products is disclosed. The dough container includes a substantially cylindrical container wall which is preferably formed from an inner liner layer, a fiberboard support layer and an outer label layer. The container of the present invention also includes at least one end cap and means for allowing internal pressure within the container to escape during proofing and until the dough expands to fill the entire volume of the container. One preferred container includes a container wall having at least one notch extending therethrough within the seam of an end cap for allowing gasses to escape. The present invention also includes a method of proofing dough comprising the steps of providing a container of the present invention, filling the container with dough such that between 70 and 99 percent of the volume of the container is filled, activating the leavening system causing the dough to substantially fill the volume of the container and sealing the container with the dough when the dough contacts a seam formed between the end cap and an end of the cylindrical body portion.

DETAILED DESCRIPTION OF THE PREFERRED EMBODIMENTS

The present invention is a dough container which includes at least one vent opening located in a seam formed between an end cap and an end of a cylindrical body portion for venting internal gasses during proofing until the dough within the container substantially fills the entire volume of the container. The container of the present invention seals when the dough expands to completely fill the volume of the container. The container of the present invention can also withstand the internal pressures generated within the can after the can is sealed and is particularly ideal for packaging refrigerated dough. The present invention effectively eliminates quality problems with refrigerated dough which are the direct result of exposure of the dough to oxygen for extended periods of time.

Figure 1:
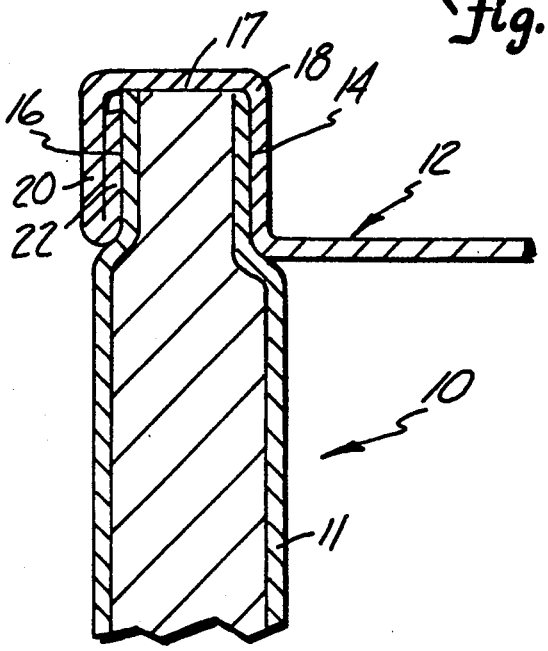
FIG. 1 is a cross-sectional view of a prior art composite dough can showing a single-crimp end cap.
Figure 2:
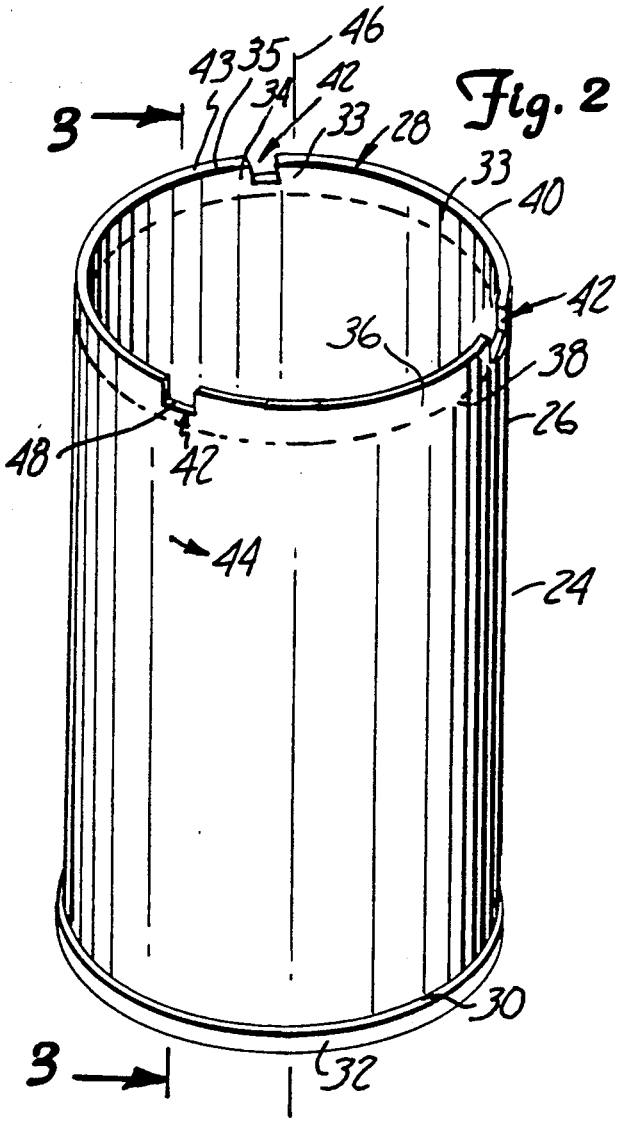
FIG. 2 is a perspective view of a preferred cylindrical body of a preferred composite container of the present invention.

A first preferred embodiment of the present invention is shown in FIG. 2. The container 24 includes a substantially cylindrical container wall 26 having a first end 28 and a second opposite end 30. The end 30 in this preferred embodiment is sealed with a single crimp end cap 32. In another embodiment, the second end 30 is integrally formed with the container wall 26.

Although the construction of the cylindrical container wall 26 according to the preferred embodiment is not critical, preferable can constructions are those which open through the side wall when pressure is applied to a wall seam. A preferred can construction includes a central fiberboard core layer of a thickness sufficient to withstand internal pressures of up to 40 psi, with an average equilibrium pressure range of between about 8 and 25 psi. The preferred fiberboard layer is about 0.021 inches thick. This thickness of fiberboard is also thick enough to withstand vacuum environments as low as 5 inches of mercury (absolute), although for this application, the containers of the present invention are not exposed to internal vacuum environments. The preferred container is helically wound by known means, and includes a helical, unglued butt joint extending from the first end 28 to the opposite end 30.

Adhesively attached to an outer surface of the fiberboard layer is an impermeable outer label layer which in the preferred embodiment is food grade kraft paper. "Kraft paper" for purposes of this disclosure is a multilayer laminate including one or more of the following materials: plastic, paper and metallic foil layers.

Adhesively attached to an inner surface of the fiberboard layer is an impermeable inner liner layer which in the preferred embodiment is food grade kraft paper. One suitable type of adhesive for bonding the outer label layer and the inner liner layer is available from the H. B. Fuller Company of St. Paul, Minn. under the product designation 1940-A Adhesive. In a preferred embodiment, the seams formed in the inner liner layer are of the anaconda type and are located proximate the butt joint such that when the outer label layer is peeled away and pressure is applied to the butt joint, the seam of the inner liner layer ruptures, exposing the dough. One such container wall construction is disclosed in Thornhill et al. U.S. Pat. No. 3,981,433 and is herein incorporated by reference. Many other suitable container wall configurations would also be suitable for use with the present invention, including an aluminum can with an integrally formed end, for example. Another example includes a container wall having an outer label layer formed from a polymer film. Any material which protects the fiberboard layer from moisture and fat would be suitable for this purpose.

The container wall 26 in a preferred embodiment includes an inner sealing surface 33 defined as an area between a circumferential reference line 34 and an edge 35 of the first end 28, the edge 35 defined by the intersection of an inner surface of the container wall 26 and the first end 28. The container 24 also has an outer sealing surface 36 defined by an area between circumferential reference line 38 and an edge 40 of the first end 28, the edge 40 defined by the intersection of an outer surface of the container wall 26 and the first end 28.

In the preferred embodiment, three vent openings, each consisting of a notch 42 extend through the inner sealing surface 33, the outer sealing surface 36 and upper surface 43 of the first end 28. Each notch 42 is preferably rectangular in shape and is of a size sufficient to allow gasses within the container to escape during proofing. In the preferred embodiment, each notch 42 is approximately 0.025 inches wide in a direction indicated by arrow 44, and is approximately 0.034 inches in depth in a direction perpendicular to arrow 44.

A preferred composite can formed according to the present invention includes three spaced apart notches 42. Although only one notch is necessary, three openings virtually eliminates the possibility of premature sealing under manufacturing conditions. Each notch extends from the first end 28 toward the reference lines 34 and 38 which in the preferred embodiment are located the same distance from the first end 28 in a direction parallel to a central can axis 46.

Figure 3:
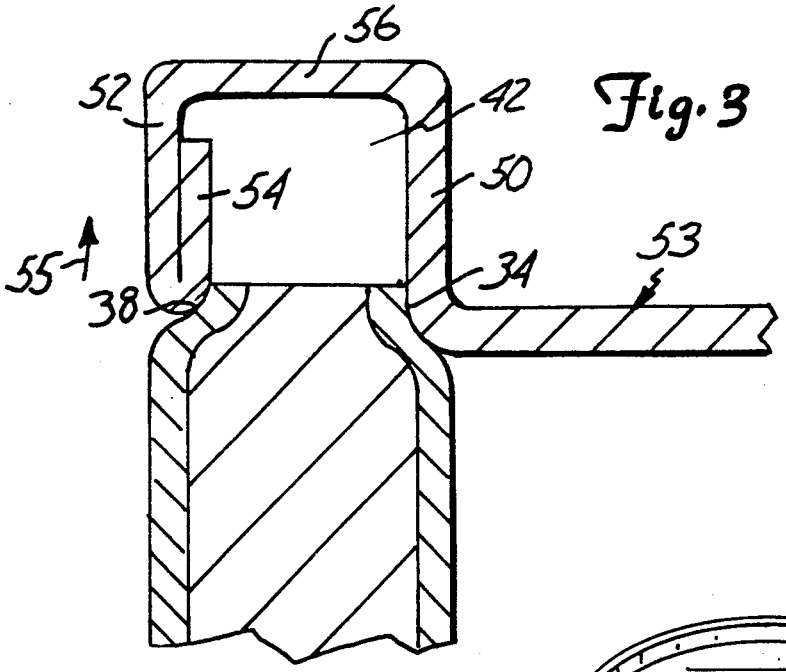
FIG. 3 is a cross-sectional view of a container of the present invention taken along line 3—3 as shown in FIG. 2.

FIG. 3 is a cross-sectional view of the first end 28 of the container wall 26 (shown in FIG. 2), taken along line 3—3 as shown in FIG. 2. According to a preferred embodiment, the portion of the notch 48 spaced furthest apart from the first end 28 is located within the inner and outer sealing surfaces 33 and 36, respectively. It is believed that the entire area defined by the notch 48 should fall within the inner sealing surface 38 and outer sealing surface 36 to adequately vent the can. According to a first preferred embodiment, the inner edge 50 of the crimped end cap 53 covers the entire inner sealing surface 33 (shown in FIG. 2) and the outer edge 52 and infolded edge 54 of the crimped end cap 53 covers the entire outer sealing surface 36 (shown in FIG. 2). The infolded edge 54 is folded against the outer edge 52 in the preferred embodiment. An upper edge 56 is located between the outer edge 52 and the inner edge 50.

In the preferred embodiment, the inner edge 50 and outer edge 52 are of substantially the same height, which in the preferred embodiment is about 0.094 inches as measured in a direction indicated by arrow 55. However, it is not necessary that these edges be of the same height. The notch 42 is preferably completely covered on both sides by the inner edge 50 and the outer edge 52.

The overall shape of the venting opening is believed to be unimportant to the present invention. In another preferred embodiment, an opening extends through the inner surface, outer surface and first end which is substantially "v" shaped. In yet another embodiment, a plurality of perforations extending through the inner and outer sealing surfaces of the container wall provide sufficient venting to allow the gasses forming within the container to be released.

It was surprisingly discovered that the rate of venting of the dough container in part controls the rate of proofing. It is most desirable to select the number and size of the vent openings in order to achieve proofing rates of no longer than four hours, and preferably between one and three hours.

The size of the vent opening should also be selected such that the inner cavity of the container after sealing remains substantially at atmospheric pressure until the dough expands to fill the cavity substantially completely. Smaller venting openings which reduce the internal pressure but do not completely eliminate a pressure differential between the inner cavity and the outside of the container would also be suitable. However, it is most desirable to maintain atmospheric pressure because it reduces the resistance to the expansion of the dough filling the headspace.

Figure 4:
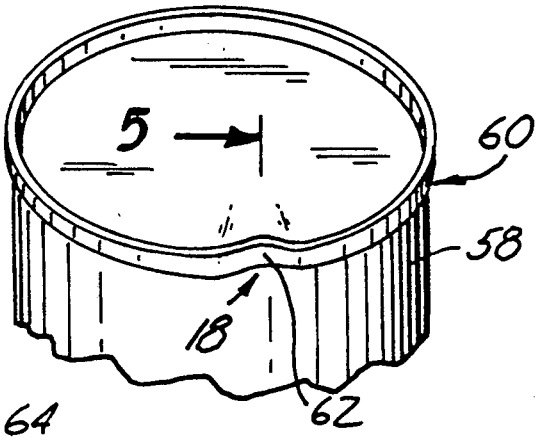
FIG. 4 is a cut away perspective view of a second preferred container of the present invention.

FIG. 4 is a partial perspective view of a second preferred embodiment of the present invention. The container wall 58 is of substantially the same construction as that described in the first preferred embodiment, except that there are no cut-out portions in the container wall for venting gasses. Instead, portions of the end cap 60 are arched forming vents 62 between the end cap 60 and the container wall 58. In this preferred embodiment, only one vent 62 is necessary to relieve the internal pressure formed from the proofing and developing of the dough during processing and refrigerated storage. However, it is preferred to include at least three openings to virtually eliminate the possibility of premature sealing.

Figure 5:
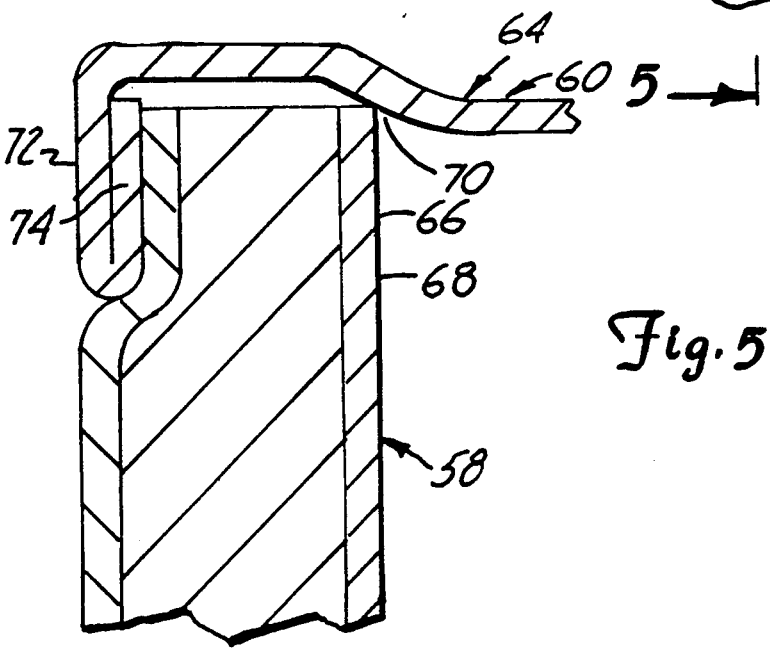
FIG. 5 is a cross-sectional view of a preferred container taken along line 5—5 as shown in FIG. 4.

FIG. 5 is a cross-sectional view of the vent 62 taken along line 5—5 as shown in FIG. 4. In this embodiment, the inner edge 64 of the end cap 60 is bent away along a portion of the perimeter of the end cap from the inner sealing surface 66. The inner sealing surface 66 in this case is defined by an area between an upper edge 70 of the inner surface of the container wall 58 and a circumferential reference line 68. Because there is substantially no contact between the end cap 60 an the inner sealing surface 66 along the vent 62 (shown in FIG. 4), gasses are permitted to escape. In this embodiment, three areas defined by a distance of approximately 0.250 inches along the outer perimeter of the end cap present along the inner edge 70 of the container wall 58 is out of contact with an inner edge 64 of the end cap 60. In this embodiment, the end cap 60 is also single crimped. The end cap includes an inner edge 70, and outer edge 72 and an infolded edge 74.

Figure 6:
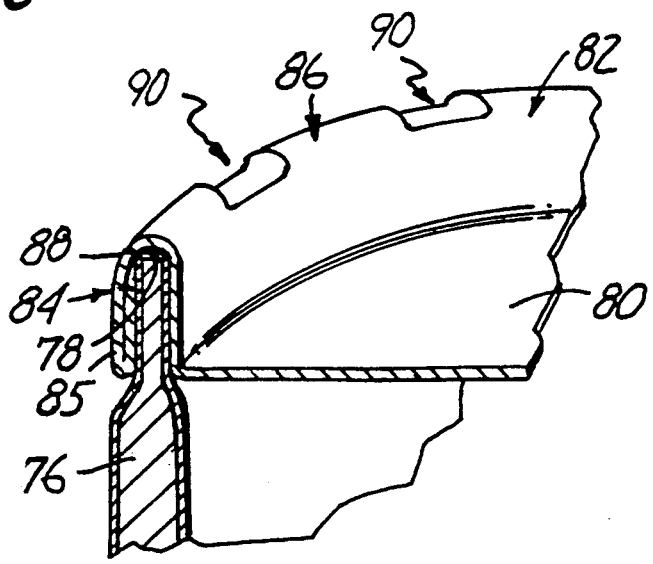
FIG. 6 is a cut-away perspective view of a third preferred container of the present invention.

A third embodiment of the container of the present invention is shown in perspective in FIG. 6. The container wall 76 is substantially of the same construction as the first preferred embodiment, except that the upper edge 78 of the container wall 76 is substantially continuous, and the container wall is free of venting openings. An end cap 80 is provided having an inner edge 82, an outer edge 84, an infolded edge 85 and an upper edge 86 defined by a fold line between inner and outer edges 82 and 84. A plurality of depressions 90 are made into the upper edge 86, creating a channel 88 for gasses to flow between the upper edge 78 of the container wall and an inner surface of the upper edge 86. In the preferred embodiment, three depressions 90 are equally spaced along the upper edge 86 to vent the can. In yet another embodiment, raised portions are provided rather than depressions, and the upper edge of the container wall contacts a portion of the inner surface of the upper edge of the end cap.

It is to be understood that the venting means shown in the three embodiments described in detail may be present on one or both ends of the can, and may be combined in a single can structure.

In all cases, providing that a sufficient amount of dough is packed into the container before crimping, the container of the present invention will permit the dough to fully expand and substantially completely fill the volume of the container before the dough seals off the container. When the dough expands to equal the volume of the cavity, it seals along a seam formed between the container wall and the end cap and will seal the container, allowing pressure to build to an equilibrium pressure.

The vent openings of the present invention may be practiced on any container which is suitable for packaging and storing refrigerated dough. That is, any container which can withstand internal pressures of up to 40 psi.

A method of proofing refrigerated dough is also disclosed. The method includes providing a container of the present invention, filling the container with between 70 and 99 percent by volume refrigerated dough, activating the leavening system to allow the dough to fill the container and sealing the container with the dough. Dough is placed in a container which provides a venting area for ensuring that the gas present in the headspace of the container is fully expunged before the container is sealed.

An example of a refrigerated dough composition suitable for use with the containers of the present invention is disclosed in Yong et al U.S. Pat. No. 4,381,315 and is incorporated herein by reference. The composition is listed in the table below. The dough product formed by the following formula is representative of refrigerated dough formulae and any refrigerated dough formula may be used with the container of the present invention. "Refrigerated dough" for purposes of this disclosure is a dough composition which is suitable for storage for extended periods of time at or below 50 degrees Fahrenheit.

TABLE

| Ingredient | Weight Percent of |
|---|---|
| Flour | 47–58 |
| Water | 28–36 |
| Saccharides | 4–10 |
| Salt | 1.0–1.5 |
| Flavoring | 0.1–7.0 |
| Emulsifiers | 0.02–1.1 |
| Dough Conditioners | 0.004–0.25 |
| Bicarbonate of Soda | 0.7–1.2 |
| Leavening Acid | 1.3–2.5 |
| Shortening | 2–25 |
| Edible Alcohol | 0–2 |

TABLE-continued

| Ingredient | Weight Percent of |
|---|---|
| Calcium Carbonate | 0–1 |

In order to select the proper amount of venting required, it is first necessary to measure the maximum rate of gas generation for the dough. The number and size of the vents is then selected such that the container vent rate is great enough to prevent pressure build-up within the container. The size and number of vents will depend upon the size of the container, the type of the product in the container and the amount of headspace remaining in the container. One preferred container is 6¼ inch in length and 2¼ inch in diameter. The "container vent rate" for purposes of this disclosure is the rate at which gasses flow through the vent openings.

Ideally, during proofing of refrigerated dough the resistance to venting value will approach zero. This will provide the least resistance against which the expanding dough must work to eliminate the headspace of the container. Thus, the headspace will be eliminated the quickest when the resistance is the lowest.

The vent openings of the present invention preferably allow the pressure within the container to remain at about atmospheric pressure throughout proofing.

The size and number of openings in the container preferably allows the headspace to exhaust completely in less than 4 hours. Using the preferred dough formulation, and filling the preferred container to approximately 80% fill, at least about 0.5 cc of gas must escape from the container per minute. Preferably, up to about 1 cc of gas per minute will escape from the preferred container. This vent rate is accomplished with three notches 42 which are approximately 0.034 inches in depth by about 0.025 inches wide.

The method of proofing to ensure the headspace gas is fully expunged is practiced in the following manner. An amount of refrigerated dough composition is placed in the container with the above-described venting means. The dough preferably fills about 70 to about 99 percent of the container volume.

During proofing, the leavening system is activated and a period of time passes to allow the dough within the container to expand. The vent openings allow gas to escape and do not prematurely plug with water or oil. Further, the vent openings allow the internal pressure of the container to remain at about atmospheric pressure throughout proofing. Once the dough has expanded to a point that it reaches the vent area, the dough blocks the vents, sealing the container. Once the container is sealed, the dough is placed at refrigeration temperatures, for example between 40 and 50 degrees Fahrenheit, where the dough develops, producing carbon dioxide and raising the internal pressure of the container to between about 8 and 28 psi.

An advantage of practicing the invention is that the leaveners present in refrigerated dough may be reduced while still ensuring that the dough will fully proof. By reducing the resistance to venting provided by the container, the dough is able to more freely expand. The leaveners therefore can produce less carbon dioxide and the dough will nevertheless expand. This advantage is reflected in cost savings of raw materials.

Although only three venting means are described in this disclosure, the present invention includes other means for venting, such as providing cut-out portions in the infolded edge of a single crimp end cap. Any modification which causes a portion of either the inner sealing surface, the outer sealing surface or both to come out of contact with a portion of the crimped end cap and which results in venting is contemplated by the present invention.

Although the present invention has been described with reference to preferred embodiments, workers skilled in the art will recognize that changes may be made in form and detail without departing from the spirit and scope of the invention.

What is claimed is:

1. A refrigerated dough container comprising:

a substantially cylindrical container body having a first and second end, the first end having an inner sealing surface, an outer sealing surface and an upper sealing surface;

a first end cap attached to the first end, the end cap having an inner edge contacting the inner sealing surface, an outer edge contacting the outer sealing surface and a folded edge having a plurality of depressions, defined by an intersection of the inner and outer edges, which partially contact the upper surface;

a second end cap attached to the second end; and means for venting internal gases during proofing until the dough substantially fills an inner cavity defined by an inner surface of the cylindrical container body, an inner surface of the first end cap and an inner surface of the second end cap, comprising at least one vent opening located within a portion of the inner sealing surface formed between at least one of the end caps and the corresponding end.

2. The container of claim 1 wherein each vent opening extends through the inner and outer sealing surfaces of at least one of the first and second ends of the container body.

3. The container of claim 2 wherein at least one end cap contacts the inner sealing surface and a portion of the outer sealing surface of the end containing at least one vent opening.

4. The container of claim 2 wherein the first end has an upper surface, and the vent opening includes at least one notch extending through portions of the inner sealing surface, the outer sealing surface and the upper surface of the first end.

5. The container of claim 4 wherein the notch is rectangular in shape.

6. The container of claim 2 wherein each vent opening comprises at least one perforation extending through both the inner and outer sealing surfaces of at least one of the first and second ends.

7. The container of claim 2 wherein at least one end cap extends over the inner and outer sealing surfaces covering each vent opening.

8. The container of claim 1 wherein the first end cap is shaped to contact only a portion of the inner sealing surface of the first end.

9. The container of claim 1 and further comprising a refrigerated dough product contained within the cavity.

10. A method of proofing refrigerated dough comprising:

providing the container of claim 1;

filling the cavity of the container with a refrigerated dough product such that between 70 and 99 percent of a volume of the cavity is filled; and activating a leavening system in the refrigerated dough product and allowing the dough to rest for a time sufficient to allow the dough to substantially fill the volume of the container, wherein the container is sealed when the dough plugs the vent openings.

* * * * *